United States Patent [19]

Remington et al.

[11] 4,318,287

[45] Mar. 9, 1982

[54] SCRAMBLE-TYPE COMBINATION LOCK

[75] Inventors: Richard C. Remington, Pompton Plains; Lazlo Bako, Woodcliff Lake, both of N.J.

[73] Assignee: Kidde, Inc. (Presto Lock Company Division), Garfield, N.J.

[21] Appl. No.: 149,520

[22] Filed: May 13, 1980

[51] Int. Cl.[3] ..... E05B 37/02; E05B 65/52

[52] U.S. Cl. ..... 70/71; 70/312

[58] Field of Search ..... 70/67, 69, 70, 71, 72, 70/73, 74, 75, 76, 312

[56] References Cited

U.S. PATENT DOCUMENTS

| | | |
|---|---|---|
| 1,343,145 | 6/1920 | Kosich . |
| 2,136,493 | 11/1938 | Denerich . |
| 2,144,047 | 1/1939 | Eden . |
| 2,163,852 | 6/1939 | Pond . |
| 2,189,342 | 2/1940 | Eber . |
| 2,267,374 | 12/1941 | Eber . |
| 3,416,338 | 12/1968 | Gehrie . |
| 3,736,778 | 6/1973 | Bako . |
| 3,961,505 | 6/1976 | Gehrie . |
| 4,048,821 | 9/1977 | Bako . |
| 4,123,923 | 11/1978 | Bako . |
| 4,155,234 | 5/1979 | Bako . |
| 4,198,837 | 4/1980 | Gisiger . |
| 4,259,856 | 4/1981 | Wingert . |
| 4,267,716 | 5/1981 | Milles . |
| 4,279,136 | 6/1981 | Milles ..... 70/71 |

*Primary Examiner*—Robert L. Wolfe

*Attorney, Agent, or Firm*—Shapiro and Shapiro

[57] ABSTRACT

A combination lock having a latch mechanism capable of being closed even when the lock is off combination employs an axially movable shaft rotatably supporting combination dials and having a latch element for engaging a cooperable hasp, the latch element being spring biased to a latched position. A slide member, the movement of which is blocked when any dial is off combination, is coupled to the latch element and the shaft and connected to a manual actuator for moving the latch element to an unlatched position. The coupling permits the latch element to move to its unlatched position independently of the slide member so that the hasp may enter the lock and be engaged by the latch element when movement of the slide member is blocked. The operating mechanism of the lock is supported on a frame by a support member connected to one end of the shaft and by a shift lever slidably related to the shaft at its opposite end.

20 Claims, 8 Drawing Figures

13
B
38
A
D
D
11
E
10
10
38
C
38
E
92
92
93
68
84
70
85
74
72
84
78
85
76
80
124
D
50
42
54
44
48
124
52
D
124
42
54
48
50
52
44
48
124
D
124
42
54
48
50
52
44
124
38
26
106
134
34
38
C
10
16
10
12
38
28
94
90
102
54
38
102
102
103
52
48
44
96
100
103
104
96
40
98
60
98
130
66
A
62
112
110
108
116
120
110
110
114
114
116
36
22
110
120
110
36
110
132
18
64
119
118
24
30
32
132
118
32
119
20
F

SCRAMBLE-TYPE COMBINATION LOCK

BACKGROUND OF THE INVENTION

This invention relates to combination locks and more particularly to combination locks which may be employed on luggage cases and the like.

Combination locks useful on luggage are well known. U.S. Pat. No. 3,416,338 to Gehrie, issued Dec. 17, 1968, and assigned to the same assignee as the present invention, discloses a combination lock comprising a plurality of combination dials rotatably supported on a shaft by associated sleeves that are engageable with the dials for rotation therewith. A slide member having a latch element is moved by a manual actuator to open the lock, but only when the sleeves have a predetermined orientation. A shift lever moves the sleeves out of engagement with the associated dials so that the combination may be changed.

Although the Gehrie lock was a decided improvement over existing comparable locks, particularly with respect to simplicity and economy of manufacture, there has been a continuing need for combination locks that are even simpler and more economical to manufacture. Moreover, some of the more recent locks have had a feature lacking in the Gehrie lock—a scramble feature that permits a hasp to be inserted into the lock even when the dials are off combination. With this feature, the dials may be turned off combination after the lock is opened, so that the combination may not be observed by unauthorized persons, and yet a hasp may be inserted into the lock without resetting the dials on combination.

SUMMARY OF THE INVENTION

It is accordingly a principal object of the invention to provide a new and improved combination lock, more particularly a combination lock of the scramble type.

A further object of the invention is to provide a combination lock that is simpler and less expensive than comparable combination locks and yet is of high quality.

Briefly stated, in one aspect a combination lock in accordance with the invention comprises latch element means movable between latched and unlatched positions, a shaft connected to the latch element means, a plurality of combination dials, means for rotatably supporting the dials on the shaft, manually actuated means coupled to the latch element means and capable of moving the latch element means to its unlatched position, while concurrently moving the shaft axially, only when the dials are set on combination, the coupling between the manually actuated means and the latch element means including means enabling the latch element means to move to its unlatched position independently of the manually actuated means.

In accordance with another aspect of the invention, a combination lock comprises a frame, a shaft having a plurality of sleeves supported for rotation thereon, a plurality of combination dials, each sleeve having means for engaging the sleeve with an associated dial for rotation therewith, means for opening the lock only when the sleeves have a predetermined orientation, support means at one end region of the shaft for supporting that end region on the frame, and shift lever means at the opposite end region of the shaft for supporting that end region on the frame, the shift lever means being movable to disengage the sleeves from the associated dials to permit the combination to be changed.

DETAILED DESCRIPTION OF THE PREFERRED EMBODIMENT

Figures 1, 2:
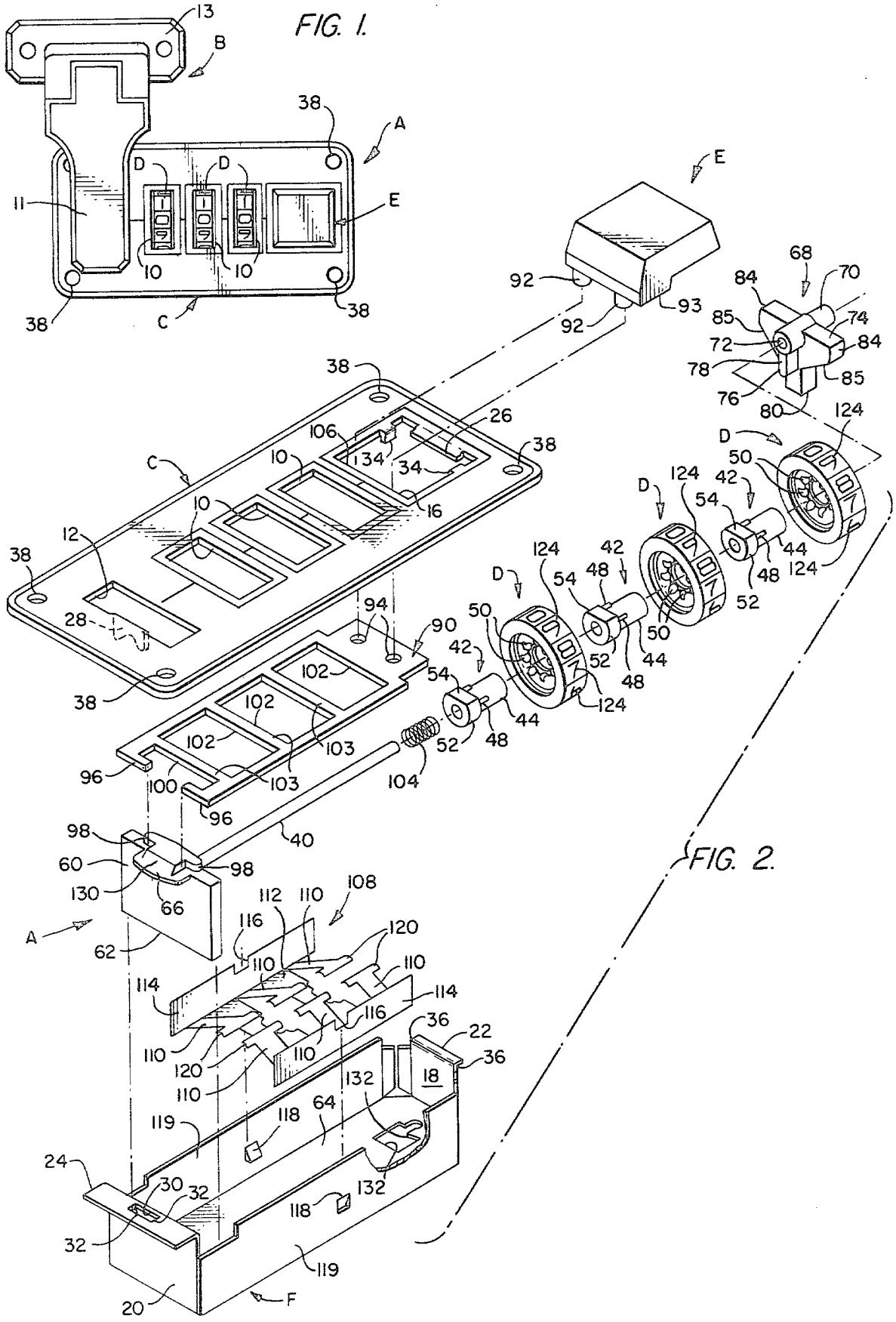
FIG. 1 is a plan view of a combination lock in accordance with the invention and an associated hasp assembly.
FIG. 2 is an exploded perspective view of the combination lock.

FIG. 1 illustrates the external appearance of a combination lock A in accordance with the invention and an associated hasp assembly B. The hasp assembly may be of conventional type, having a hasp 11 pivotally supported on a base 13 and spring biased away from the lock. As shown in FIGS. 1 and 2, the combination lock generally comprises a face plate C, a plurality of combination dials D, a manual actuator or puller E and a frame or back cover F. As will be described in detail hereinafter, when the combination dials are "on combination," the manual actuator may be operated to open the lock and release the hasp to an open position. As will also be explained, the combination lock incorporates a scrabble feature that allows the hasp to be moved to a closed position even when the combination dials are "off combination."

As shown in FIG. 2, face plate C may be a substantially rectangular planar member, preferably of sheet metal. Transverse slots 10 are centrally located in the face plate for corresponding dials D. The face plate also has a transverse slot 12 positioned adjacent to one end thereof for receiving a latch member 14 that is part of hasp 11 (see FIG. 4). A somewhat larger opening 16 is located adjacent to the opposite end of the face plate for receiving manual actuator E, as will be described.

As shown in FIGS. 2 and 4–6, frame F, which may be conveniently formed of sheet-metal, comprises an elongated U-shaped channel having closed end portions 18, 20. Projecting outwardly from end portions 18, 20 are lips or tabs 22, 24, respectively. As shown in FIG, 4, when the frame and face plate are assembled to form a case for the combination lock, lip 22 is supported on a depending ledge portion 26 formed along one side of opening 16 in the face plate (FIG. 2), and a depending bifurcated tab 28 formed in the face plate at one side of slot 12 is received in a corresponding slot 30 in lip 24 (FIG. 2). To assemble the frame and the face plate to form the lock case, lip 22 may be placed on ledge 26 and the frame and the face plate pressed together so that depending tab 28 enters slot 30, where the tab may be spread and trapped behind the edges 32 of slot 30.

As shown in FIG. 2, depending tabs 34 may also be formed at opposite sides of opening 16 in the face plate and positioned to lie on opposite sides 36 of lip 22 when the frame and face plate are assembled, to assit in properly locating lip 22 on ledge 26. Face plate C may be provided with a plurality of holes 38 adjacent to its corners for attaching the combination lock to a luggage case, for example.

Figure 3:
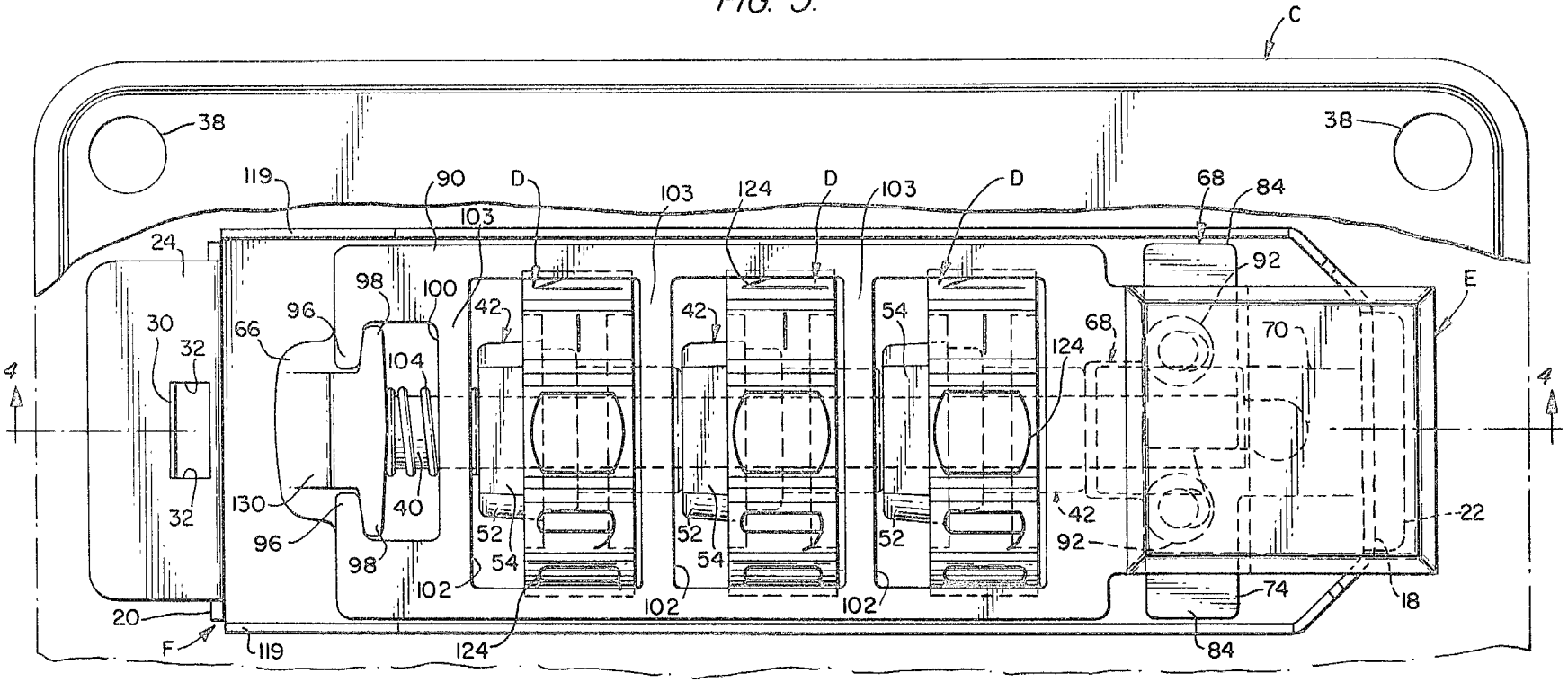
FIG. 3 is a top view, partially broken away, of the combination lock.
Figure 8:
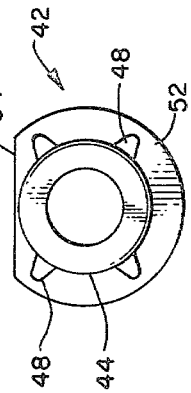
FIG. 8 is an elevation view of a sleeve that may be employed in the combination lock.
Figure 7:
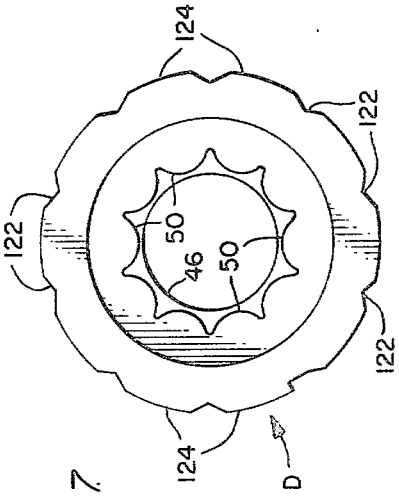
FIG. 7 is an elevation view of a combination dial.
Figure 4:
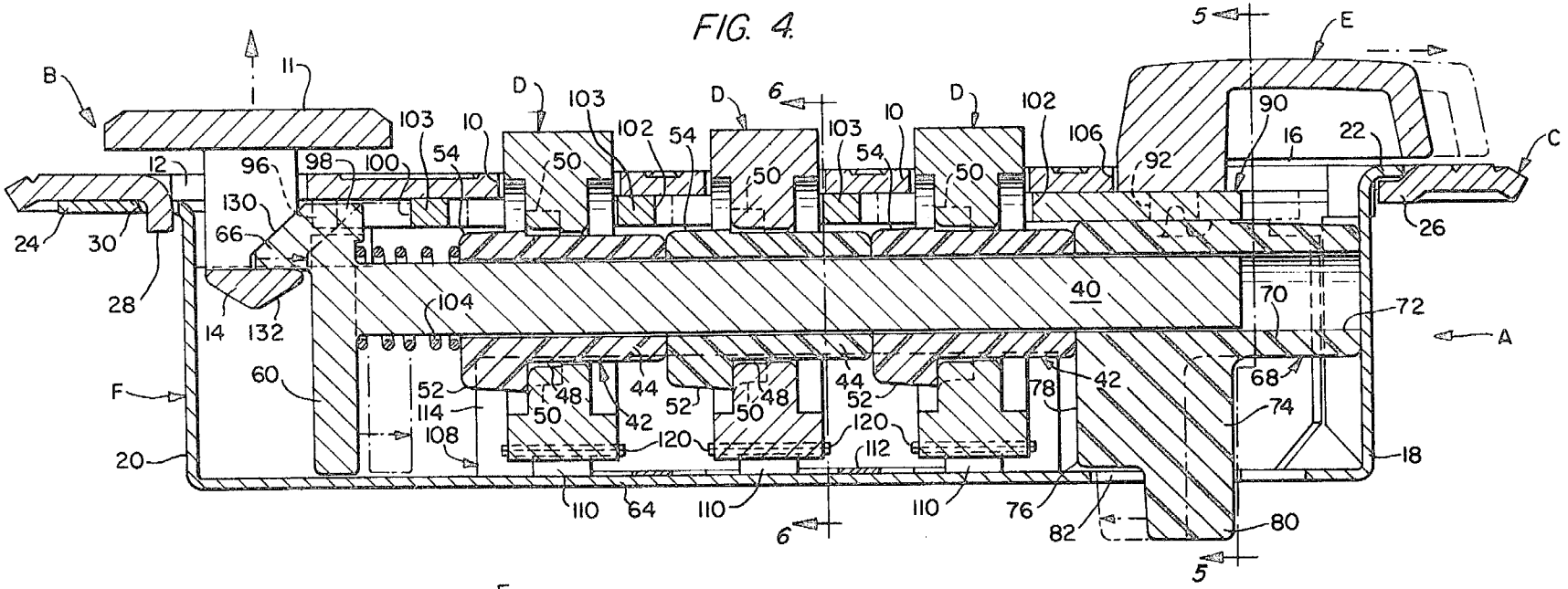
FIG. 4 is a longitudinal sectional view taken approximately along the line 4—4 of FIG. 3.

The various components which comprise the operating mechanism of the combination lock of the invention and their relationships to one another can best be appreciated from FIGS. 2–4. As shown, each dial D is rotatably supported on a longitudinally extending shaft 40 by an associated sleeve 42. As is well known, each sleeve may have a hub 44 (FIG. 7) sized to be received in a central opening 46 in its dial (FIG. 7), and may have a plurality of teeth 48 spaced around the periphery of the hub which are received in recesses 50 in the dial to releasably lock each sleeve with its associated dial. The sleeves are rotatable about shaft 40 with the dials and are movable axially with respect to the dials in a manner which will be explained. In the form shown each sleeve has a circular flange portion 52 and a flat portion 54 (FIG. 8) which are located at one side of the dial, as shown in FIGS. 3 and 4, when the sleeves are coupled to the dials. Sleeves 42 are preferably formed of molded plastic.

As shown in FIGS. 2 and 4, one end of shaft 40 has a support member 60 connected thereto. The support member, which is preferably formed integrally with the shaft by die casting, may be substantially planar and have a base or bottom portion 62 slidably disposed on the bottom 64 of frame F for supporting the shaft on the frame. The top of support member 60 has an integral nose-like projection 66, as shown, which forms a latch element. When the lock is assembled, latch element 66 is positioned adjacent to slot 12 in the face plate for engaging the latch member 14 of hasp 11, as shown in FIG. 4, to hold the hasp in a closed position. As will be described shortly, when the combination lock is on combination and the manual actuator E is operated, latch element 66 is moved in the axial direction of shaft 40, disengaging it from latch element 14 and releasing the hasp. As shown in FIG. 2, support member 60 preferably has a width slightly less than the width of frame F in order to provide confined movement of the support member, shaft and latch element along the frame channel. Shaft 40, support member 60 and latch element 66 together constitute a one-piece bolt, which is movable between latched and unlatched positions. As will be described, movement of the bolt is not blocked when the lock is off combination.

Figure 5:
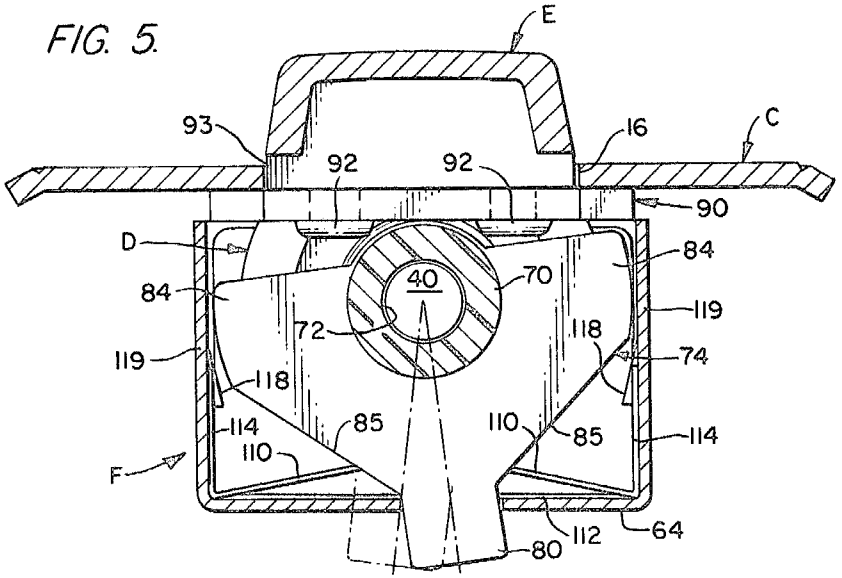
FIG. 5 is a transverse sectional view taken approximately along the line 5—5 of FIG. 4.

As also shown in FIGS. 2 and 4, a shift lever 68 is located at an opposite end region of shaft 40 from support member 60. The shift lever, preferably shaped as shown in FIG. 2, has a cylindrical portion 70 with a centrally located bore 72 for slidably mounting the shift lever on the shaft. As shown in FIGS. 2 and 5, the shift lever has a first depending member 74, which is somewhat Y-shaped, centrally located on cylindrical portion 70, and a second depending member 76 extending between member 74 and the forward end 78 (left end in FIG. 4) of cylindrical portion 70. As shown in FIG. 4, a portion 80 of member 74 extends through a cut-out 82 in the bottom 64 of frame F, for a purpose which will be explained. Member 76, however, engages the bottom of the frame to support one end of the shaft. As shown in FIG. 5, the wide portions 84 of member 74 are sized with respect to the width of the frame to provide lateral support to shaft 40, and the sloped portions 85 connecting wide portions 84 to portion 80 allow shift lever 68 to be rotated slightly about shaft 40, for a purpose which will be explained. The shift lever is preferably made of molded plastic.

Slidably disposed on the underside of face plate C is a slide member 90, one end of which is connected to manual actuator E (FIGS. 2 and 4). For this purpose, the manual actuator may be formed with depending studs 92 which are received in corresponding openings 94 in the end of the slide member, and the studs expanded or swedged over to connect the manual actuator to the slide member. As shown in FIGS. 2 and 3, the opposite end of the slide member is formed with inwardly turned projections 96 which form hook portions adapted to engage corresponding abutments or hook receiving portions 98 formed on the top of support member 60 for coupling the slide member to the bolt. Adjacent to hook portions 96, the slide member is formed with a cut-out or notch 100 which permits relative movement between the slide member and the bolt. The slide member is also formed with a plurality of slots 102 wider than slots 10 in the face plate. When the lock is assembled, slots 102 are positioned beneath and aligned with corresponding slots 10 in the face plate and the dials pass through the aligned slots. The flange portions 52 of the sleeves and the bars 103 at the sides of slots 102 constitute cooperable blocking means, as will be explained, to prevent movement of the slide member by the manual actuator when the dials are off combination.

Manual actuator E is preferably a die cast member having a substantially rectangular shape as illustrated in the figures. The manual actuator may have a stepped portion 93 at its lower side from which studs 92 depend. The stepped portion is sized to be received in opening 16 of face plate C, as illustrated in FIGS. 2, 4 and 5, and to permit the manual actuator to slide within the opening.

As shown in FIGS. 2 and 4, a resilient member 104, which may be a compression coil spring, is located on the shaft between support member 60 and an adjacent sleeve 42. In the relationships of the parts illustrated in FIG. 4, coil spring 104 is slightly compressed, urging shaft 40 to the left and urging the sleeves into engagement with the dials and into abutting end-to-end relationship against shift lever 68, which abuts end portion 18 of the frame. Movement of shaft 40 to the left beyond the solid line portion of FIG. 4 is prevented by the engagement between hook portions 96 of the slide member and abutments 98 on support member 60 and by the engagement of the manual actuator with the side 106 of opening 16 in the face plate. In the solid line position illustrated in FIG. 4, latch element 66 is in latched position, being located adjacent to slot 12 in face plate C for engaging the hasp assembly as previously described.

Figure 6:
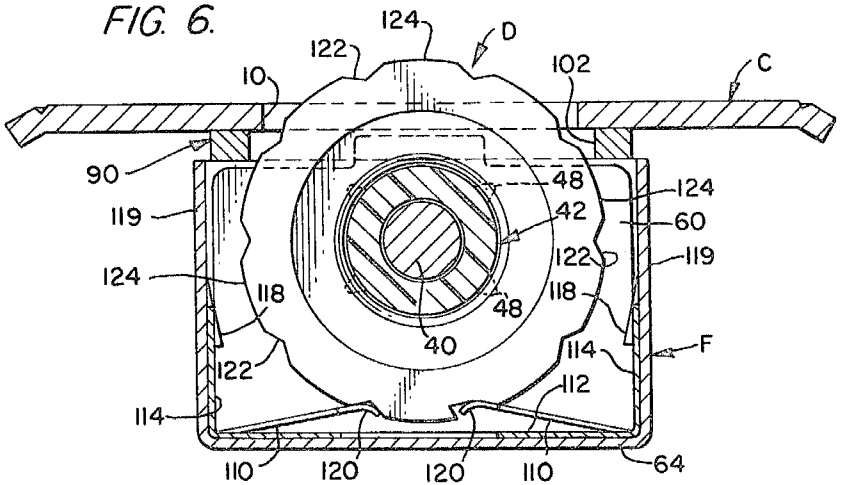
FIG. 6 is a transverse sectional view taken approximately along the line 6—6 of FIG. 4.

The combination lock also includes a dial spring 108 (FIG. 2) located on base 64 of the frame. As shown, the dial spring, which is preferably formed of spring tempered phosphorous bronze, may have a plurality of arms 110 struck upwardly and inwardly from locations adjacent to the edge regions of a base 112, and may have a pair of substantially parallel side members 114. A notch 116 may be centrally located in each side member 114 as shown. As illustrated in FIGS. 5 and 6, the width of the dial spring may be substantially equal to the width of frame F so that when the spring is located on base 64, side members 114 engage the sides 119 of the frame, and notches 116 are positioned below inwardly projecting tabs 118 formed in sides 119 to hold the spring on the frame.

As shown in FIG. 6, the end 120 of each dial spring arm 110 may be rounded to engage corresponding index notches 122 equally spaced around the periphery of the dials. The dial spring arms and the index notches allow the dials to be held in discrete rotational positions to centrally display in slots 10 successive indicia 124 on the periphery of the dials.

In operation, when the dials D are rotated to the on combination positions, the flat portions 54 of the sleeves are located adjacent to slide member 90 outside of the slots 102, as illustrated in FIG. 4. With the sleeves in this position, the manual actuator and the slide member may be moved to the right to the phantom line position illustrated in FIG. 4, bars 103 of the slide member bypassing corresponding flat portions 54. When the slide member moves to the right, the engagement between hook portions 96 and abutments 98 on support member 60 moves the support member and, hence, latch element 66 and shaft 40, to the phantom line positions shown, against the bias of spring 104. This is the unlatched position of the latch mechanism in which latch element 66 is disengaged from latch member 14 of hasp 11. As the shaft moves axially to the right, it moves relative to the sleeves and to the shift lever. Since the shift lever abuts end portion 18 of the frame, spring 104 is further compressed by movement of the support member, and the sleeves are maintained in coupled relationship with their respective dials. When the manual actuator is released, spring 104 returns latch element 66, support member 60 and shaft 40 to the latched or solid line position illustrated in FIG. 4.

If any dial is off combination, the flange portion 52 of its associated sleeve enters a corresponding slot 102 of the slide member. The flange portion of the sleeve and the adjacent bar 103 of the slide member form blocking abutments to prevent movement of the slide member to the unlatched position by operation of the manual actuator. Accordingly, latch element 66 cannot be moved to its unlatched position. The height of support member 60 limits the vertical (in FIG. 4) movement of the latch element.

The scramble feature of the lock operates in the following manner. After the lock has been opened, the dials may be rotated off combination to prevent the combination from being observed by unauthorized persons. As shown in FIG. 4, the upper leading edge 130 of latch element 66 and the lower edge portion 132 of latch member 14 of hasp 11 are shaped to provide cooperable cam surfaces. When the hasp is moved into slot 12 in face plate C, cam surfaces 130 and 132 engage, forcing the latch element 66 and the shaft 40 to the right against the bias of spring 104. As shown in FIG. 3, abutments 98 on the support member 60 are free to disengage from hook portions 96 and move within slot 100 of the slide member, allowing relative movement between the latch element and the slide member.

Accordingly, the latch element is able to move to its unlatched position when the slide member is blocked by the sleeves. Once latch member 14 of the hasp has entered slot 12, spring 104 forces latch element 66 back to its latched position to engage latch member 14 and lock the lock.

In order to change the combination, the sleeves may be disengaged from the dials by moving the shift lever leftwardly in FIG. 4 to the phantom line position. Since the shaft is prevented from moving by the engagement between hook portions 96 of the slide member and abutments 98 on the support member, movement of the shift lever to the left along the shaft compresses spring 104 between support member 60 and the adjacent sleeve 42. As the shift lever is moved to the left, it may be rotated clockwise from the solid line position to place portion 80 behind edge 132 of cut-out 82 (FIG. 2). Spring 104 urges the shift lever against edge 132 and holds the shift lever in a shifted position, with the sleeves disengaged from the dials to allow the dials to be rotated to the desire combination, the sleeves being held against rotation by engagement of their flat portions 54 with bars 103. Once the dials are set to the new combination, the shift lever may be rotated counterclockwise (in FIG. 5) to disengage it from surface 132. Spring 104 then forces the shift lever back into engagement with end portion 18 of the frame, reengaging the sleeves and the dials and setting the new combination into the lock. The dials are prevented from moving axially by slots 10 in face plate C.

As is apparent from the foregoing, the combination lock of the invention is remarkable in its simplicity. By utilizing various parts of the combination lock to perform multiple functions, a relatively small number of parts is required. For example, the one-piece construction of shaft 40, support member 60 and latch element 66 allows this component to function as a shaft for rotatably supporting the sleeves and the dials, as a movable bolt for engaging a cooperable hasp, and as a support member for supporting the operating mechanism of the lock on the frame. Similarly, a single spring serves not only to urge the latch element toward its latched position, it also serves to retain the sleeves in coupled relationship with their respective dials and serves as a return spring for the manual actuator and the slide member. The spring also cooperates with the shift lever to permit the combination to be changed, and the shift lever also functions as a support for the operating mechanism. Moreover, as is apparent from the foregoing, the various parts of the combination lock have a relatively simple configuration and construction, and the lock may be quickly and easily assembled. Accordingly, it is very economical to produce.

While the foregoing has been with reference to a particular described embodiment, it will be apparent to those skilled in the art that changes can be made in this embodiment without departing from the principles and spirit of the invention, the scope of which is defined in the appended claims.

We claim:

1. A combination lock comprising latch element means movable between latched and unlatched positions, a shaft connected to said latch element means, a plurality of combination dials, means for rotatably supporting the dials on the shaft, manually actuated means coupled to said latch element means and capable of moving said latch element means to its unlatched position, while concurrently moving said shaft axially, only when the dials are set on combination, the coupling between said manually actuated means and said latch element means including means enabling the latch element means to move to its unlatched position independently of said manually actuated means.

2. The lock of claim 1, wherein the means for rotatably supporting the dials comprises a plurality of sleeves supported for rotation on the shaft, each sleeve having means for engaging the sleeve with an associated dial for rotation therewith, and the sleeves having means for preventing the manually actuated means from moving said latch element means to its unlatched position except when the sleeves have a predetermined orientation.

3. The lock of claim 2, wherein the manually actuated means comprises a slide member and a manual actuator connected to the slide member for moving the slide member in the axial direction of the shaft.

4. The lock of claim 3, wherein the slide member has slots through which the dials pass and has bars engageable with the sleeves to block movement of the slide member except when the sleeves have said predetermined orientation.

5. The lock of claim 4, wherein the lock has a face plate with slots through which the dials project, the slide member being located directly behind the face plate.

6. The lock of claim 2, further comprising a frame and means for supporting the shaft for axial movement on the frame.

7. The lock of claim 6, wherein the shaft supporting means comprises a support member fixed to the shaft and to the latch element means at one end of the shaft, and further means for supporting the opposite end of the shaft.

8. The lock of claim 7, wherein the frame comprises a channel and the support member is shaped for confined movement along the channel.

9. The lock of claim 7, wherein the further means for supporting the opposite end of the shaft comprises a shift lever for moving the sleeves out of engagement with the associated dials to permit the combination to be changed.

10. The lock of claim 9, wherein the shift lever is supported for movement axially of the shaft and around the shaft.

11. The lock of claim 9, wherein the shift lever is shaped to provide lateral support for the shaft on the frame.

12. The lock of claim 7, further comprising coil spring means on the shaft and compressed between the support member and an adjacent sleeve for biasing the latch element means toward its latched position, for biasing each sleeve into engagement with the associated dial, and for biasing the plurality of sleeves into engagement with the shift lever.

13. A combination lock comprising a frame, a shaft having a plurality of sleeves supported for rotation thereon, a plurality of combination dials, each sleeve having means for engaging the sleeve with an associated dial for rotation therewith, means for opening the lock only when the sleeves have a predetermined orientation, support means at one end region of the shaft for supporting that end region on the frame, and shift lever means at the opposite end region of the shaft for supporting that end region on the frame, the shift lever means being movable to disengage the sleeves from the associated dials to permit the combination to be changed.

14. The lock of claim 13, wherein the support means is fixed to the shaft and is slidably disposed on the frame for movement with the shaft in the axial direction of the shaft.

15. The lock of claim 14, wherein the frame comprises a channel and the support means is shaped for confined movement along the channel.

16. The lock of claim 13, wherein the support means has latch element means fixed thereto.

17. The lock of claim 16, wherein the latch element means, the support means, and the shaft are one piece.

18. The lock of claim 17, further comprising coil spring means on the shaft and compressed between the support means and an adjacent sleeve for biasing the latch element means toward a latched position, for biasing each sleeve into engagement with the associated dial, and for biasing the plurality of sleeves into engagement with the shift lever means.

19. The lock of claim 18, wherein the shift lever means has a bore through which the shaft extends, the shift lever means being movable along the shaft axially and being movable around the shaft.

20. The lock of claim 13, wherein the shift lever means is shaped to provide lateral support for the shaft on the frame.

* * * * *